US011735150B2

(12) United States Patent
Sato et al.

(10) Patent No.: US 11,735,150 B2
(45) Date of Patent: Aug. 22, 2023

(54) KEYBOARD DEVICE

(71) Applicant: Roland Corporation, Shizuoka (JP)

(72) Inventors: Hitoshi Sato, Shizuoka (JP); Yoshitaka Fujiwara, Shizuoka (JP); Mutsuo Sawada, Shizuoka (JP)

(73) Assignee: Roland Corporation, Shizuoka (JP)

( * ) Notice: Subject to any disclaimer, the term of this patent is extended or adjusted under 35 U.S.C. 154(b) by 0 days.

(21) Appl. No.: 17/273,284

(22) PCT Filed: Sep. 4, 2018

(86) PCT No.: PCT/JP2018/032709
§ 371 (c)(1),
(2) Date: Mar. 3, 2021

(87) PCT Pub. No.: WO2020/049627
PCT Pub. Date: Mar. 12, 2020

(65) Prior Publication Data

US 2021/0343263 A1 Nov. 4, 2021

(51) Int. Cl.
*G10H 1/34* (2006.01)
*G10C 3/12* (2006.01)

(52) U.S. Cl.
CPC ..... *G10H 1/346* (2013.01); *G10C 3/12* (2013.01); *G10H 2220/221* (2013.01)

(58) Field of Classification Search
CPC ..... G10H 1/346; G10H 2220/221; G10C 3/12
See application file for complete search history.

(56) References Cited

U.S. PATENT DOCUMENTS 6,087,576 A * 7/2000 Masubuchi ..... G10C 3/12 84/433
2007/0017338 A1* 1/2007 Nishida ..... G10C 3/12 84/423 R
2009/0007757 A1* 1/2009 Nishida ..... G10H 1/346 84/433

FOREIGN PATENT DOCUMENTS

| | | |
|---|---|---|
| JP | H07092963 | 4/1995 |
| JP | H10240225 | 9/1998 |
| JP | H10240226 | 9/1998 |
| JP | 2000066660 | 3/2000 |
| JP | 2007052401 | 3/2007 |
| JP | 2008076720 | 4/2008 |

OTHER PUBLICATIONS

"Office Action of Japan Counterpart Application" with English translation thereof, dated Feb. 15, 2022, p. 1-p. 8.
"International Search Report (Form PCT/ISA/210)" of PCT/JP2018/032709, dated Nov. 27, 2018, with English translation thereof, pp. 1-3.

* cited by examiner

*Primary Examiner* — Jianchun Qin
(74) *Attorney, Agent, or Firm* — JCIPRNET

(57) ABSTRACT

A keyboard device is provided, and includes multiple keys and multiple hinges. Each of the keys is supported by a support member. Each of the hinges has: a pair of base parts, joined to the support member and separated from each other with a predetermined gap therebetween in a width direction of the keys, and a connection part, connecting the pair of base parts and each of the keys to each other in a longitudinal direction of the keys. A dimension of the connection part in the longitudinal direction of the keys is set to be larger than dimensions of the base parts in the width direction of the keys.

12 Claims, 6 Drawing Sheets

KEYBOARD DEVICE

CROSS-REFERENCE TO RELATED APPLICATION

This application is a 371 application of the international PCT application serial no. PCT/JP2018/032709, filed on Sep. 4, 2018. The entirety of the above-mentioned patent application is hereby incorporated by reference herein and made a part of this specification.

TECHNICAL FIELD

The present invention relates to a keyboard device and particularly relates to a keyboard device of which product costs can be reduced.

BACKGROUND ART

Keyboard devices in which keys are joined to a support member via hinges such that a base end side of the keys is supported by the hinges in a rockable manner are known. For example, Patent Literature 1 discloses a keyboard device which includes a restricting wall member having a restricting wall and fixed to a key support part (support member) and a restricted wall member having a restricted wall and fixed to white keys, and in which the restricting wall of the restricting wall member and the restricted wall of the restricted wall member are arranged with a very small gap therebetween in a width direction of the keys. According to this keyboard device, when the keys tend to roll (the keys are distorted around an axis in a longitudinal direction) at the time of key touching, the restricted wall can be brought into contact with the restricting wall, and therefore rolling of the keys can be curbed.

CITATION LIST

Patent Literature

[Patent Literature 1] Japanese Patent Laid-Open No. 2008-076720 (for example, Paragraph 0030 and FIGS. 1 and 2)

However, the technology in the related art described above has a configuration in which rolling of keys is restricted by separately providing members for guiding rocking of the keys (a restricting wall member and a restricted wall member). Therefore, there are problems that a structure of supporting the keys becomes complicated and product costs of the keyboard device are high.

The present invention has been made to solve the problems described above, and an object thereof is to provide a keyboard device of which product costs can be reduced.

SUMMARY

Solution to Problem

In order to achieve this object, according to the present invention, there is provided a keyboard device including a plurality of keys each of which is supported by a support member; and a plurality of hinges each of which has a pair of base parts joined to the support member and separated from each other with a predetermined gap therebetween in a width direction of the keys, and a connection part connecting the pair of base parts and each of the keys to each other in a longitudinal direction of the keys. A dimension of the connection part in the longitudinal direction of the keys is set to be larger than dimensions of the base parts in the width direction of the keys.

DESCRIPTION OF THE EMBODIMENTS

Figure 1:
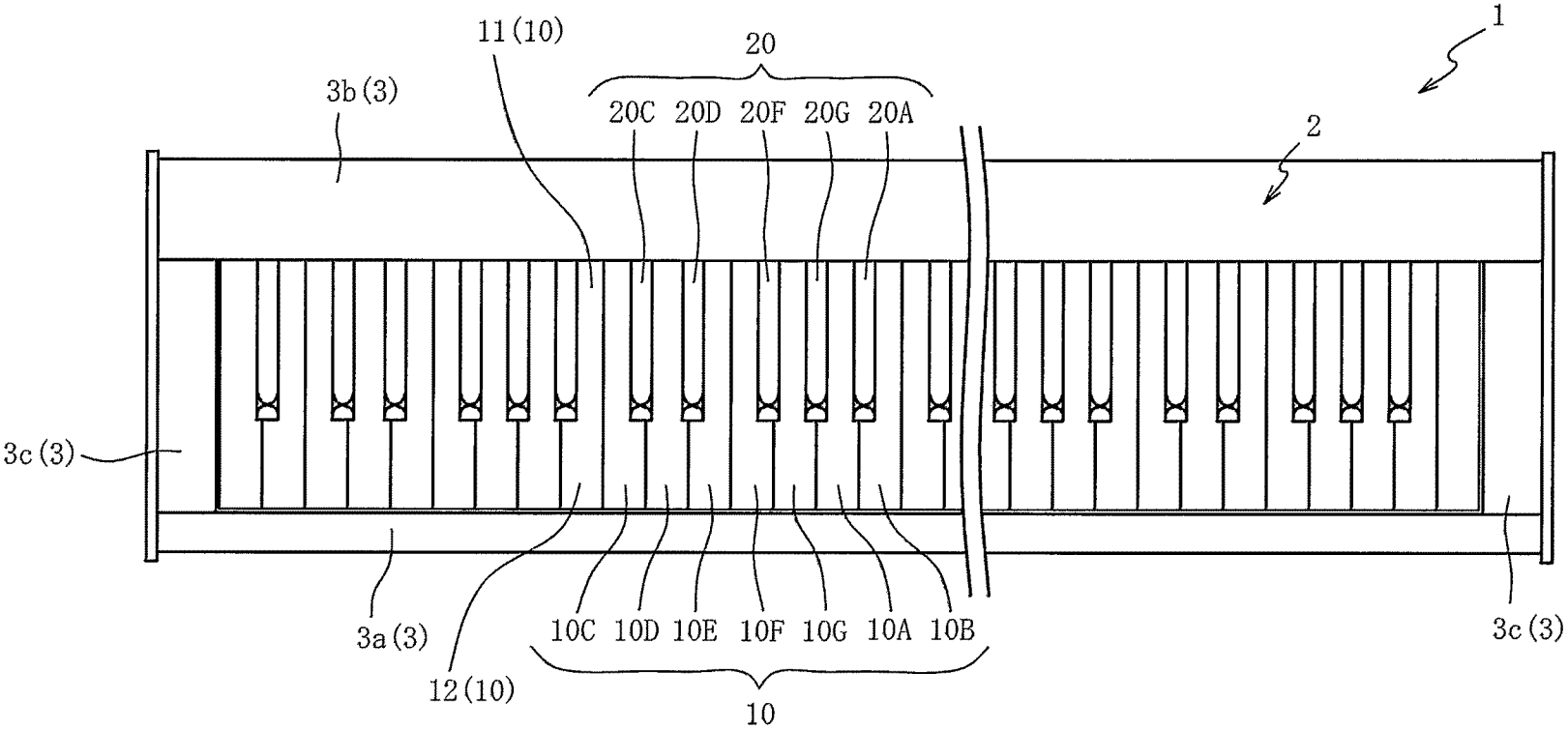
FIG. 1 is a top view of a keyboard device according to a first embodiment.

Hereinafter, preferable embodiments will be described with reference to the accompanying drawings. First, with reference to FIG. 1, an overall configuration of a keyboard device 1 will be described. FIG. 1 is a top view of the keyboard device 1 according to a first embodiment. In FIG. 1, in order to simplify the drawings, the keyboard device 1 is schematically illustrated by omitting a portion of the configuration thereof.

As illustrated in FIG. 1, the keyboard device 1 is constituted as a keyboard instrument (electric piano) including a plurality of (in the present embodiment, 88) keys 2, and a panel 3 surrounding an area around the plurality of keys 2. The keys 2 includes a plurality of (in the present embodiment, 52) white keys 10 for playing natural tones and a plurality of (in the present embodiment, 36) black keys 20 for playing derived tones, and the plurality of white keys 10 and the plurality of black keys 20 are provided side by side in a left-right direction (a width direction of the keys 2).

Each of the white keys 10 includes a narrow width part 11 extending from a base end side thereof toward a front side, and a wide width part 12 connected to a distal end of the narrow width part 11 and having a left-right direction dimension set to be larger than that of the narrow width part 11. The black keys 20 are arranged between the narrow width parts 11 of the white keys 10.

In the following description, when the white keys 10 are individually identified in accordance with pitch names (C, D, E, F, G, A, and B), they will be described by applying corresponding pitch names thereto (for example, a white key 10 corresponding to the pitch name C is referred to as "a white key 10C"). Also, similarly, when the black keys 20 are individually identified in accordance with pitch names (C♯, D♯, F♯, G♯, and A♯), they will be described by applying corresponding pitch names thereto (for example, a black key 20 corresponding to the pitch name C♯ is referred to as "a black key 20C").

The panel 3 includes a front panel 3*a*, a back panel 3*b* disposed opposite to the front panel 3*a* in a longitudinal direction (a vertical direction in FIG. 1), and a pair of end panels 3*c* connecting end parts of the front panel 3*a* and the back panel 3*b* in the left-right direction to each other. The white keys 10 and the black keys 20 are surrounded by the front panel 3*a*, the back panel 3*b*, and the pair of end panels 3*c*.

On an upper surface of the back panel 3*b* (a surface on the front side on the paper in FIG. 1), for example, a display device formed using an LED, a liquid display, or the like for displaying various states; a plurality of operation pieces for adjusting a volume, changing between modes, and the like; and the like are arranged (none is illustrated). Also, on a back surface of the back panel 3*b*, for example, a power supply switch, a plurality of jacks for inputting and outputting MIDI signals or audio signals, and the like are arranged (none is illustrated).

Also, the keyboard device 1 includes a switch (not illustrated) which is turned on/off due to rocking of the white keys 10 and the black keys 20 in response to an operation (key touching or key release) of a player, and the switch is turned on/off when a player touches the white keys 10 or the black keys 20. Key touching information (note information) of the white keys 10 and the black keys 20 is detected due to on/off operation of this switch, and musical sound signals based on results of detection thereof are output to outside.

Figure 2:
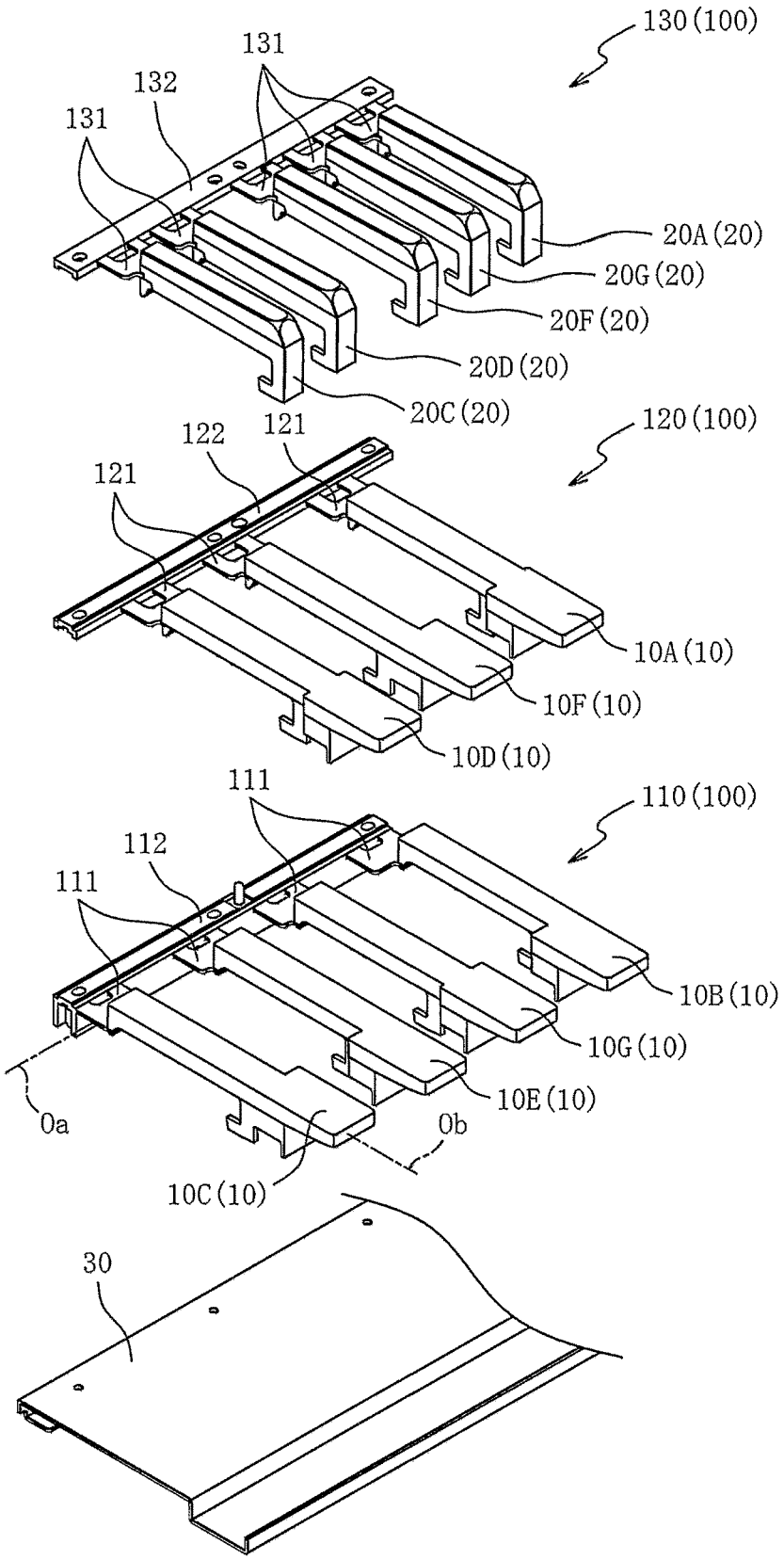
FIG. 2 is an exploded perspective view of the keyboard device.

Next, with reference to FIG. 2, a detailed configuration of the keyboard device 1 will be described. FIG. 2 is an exploded perspective view of the keyboard device 1. In FIG. 2, in order to simplify the drawings, the keyboard device 1 is schematically illustrated by omitting a portion of the configuration thereof.

As illustrated in FIG. 2, the keyboard device 1 includes a chassis 30 formed using synthetic resin, a steel plate, or the like, and a key unit 100 fixed to the chassis 30. The key unit 100 is a unit including the white keys 10 and the black keys 20 constituting an octave in the plurality of white keys 10 and the black keys 20 of the keyboard device 1. Namely, the keyboard device 1 is constituted by arranging a plurality of key units 100 in the left-right direction and supporting the key units 100 with the chassis 30.

The key unit 100 includes a bottom-section unit 110 fixed to the chassis 30, a middle-section unit 120 overlapping the bottom-section unit 110, and an upper-section unit 130 overlapping the middle-section unit 120.

The bottom-section unit 110 is a unit for supporting the plurality of white keys 10 (in the present embodiment, white keys 10C, 10E, 10G, and 10B with four pitch names arranged for every other pitch name). The bottom-section unit 110 includes a plurality of bottom-section hinges 111 respectively connected to base ends of the plurality of white keys 10 and formed to have a flat plate shape, and a bottom-section support member 112 supporting the white keys 10 in a rockable manner via the bottom-section hinges 111. The white keys 10, the bottom-section hinges 111, and the bottom-section support member 112 are integrally formed using a resin material.

The middle-section unit 120 is a unit for supporting the plurality of white keys 10 (in the present embodiment, white keys 10D, 10F, and 10A with three pitch names arranged for every other pitch name). The middle-section unit 120 includes a plurality of middle-section hinges 121 respectively connected to the base ends of the plurality of white keys 10 and formed to have a flat plate shape, and a middle-section support member 122 supporting the white keys 10 in a rockable manner via the middle-section hinges 121. The white keys 10, the middle-section hinges 121, and the middle-section support member 122 are integrally formed using a resin material.

The upper-section unit 130 is a unit for supporting each of the black keys 20 (black keys 20C, 20D, 20F, 20G, and 20A) constituting an octave. The upper-section unit 130 includes a plurality of upper-section hinges 131 respectively connected to the base ends of the plurality of black keys 20 and formed to have a flat plate shape, and an upper-section support member 132 supporting the black keys 20 in a rockable manner via the upper-section hinges 131. The black keys 20, the upper-section hinges 131, and the upper-section support member 132 are integrally formed using a resin material.

In the following description, the bottom-section unit 110, the middle-section unit 120, and the upper-section unit 130 will be abbreviated in the description as "each of the units 110, 120, and 130", and the hinges and the support members constituting the units will be described in a similar manner (for example, abbreviated such as each of the hinges 111, 121, and 131).

Each of the support members 112, 122, and 132 is provided in a manner of extending in the left-right direction of the chassis 30. The middle-section support member 122 is fitted to an upper surface of the bottom-section support member 112, the upper-section support member 132 is fitted to an upper surface of the middle-section support member 122, and the key unit 100 is constituted by fastening and fixing each of the support members 112, 122, and 132 using screws (not illustrated). Accordingly, each of the plurality of white keys 10 and the black keys 20 is supported in a rockable manner by each of the hinges 111, 121, and 131 at a different height position.

Thus, for example, at the time of key touching of the white keys 10 connected to the bottom-section hinges 111, the white keys 10 rotate mainly around an axis Oa in the left-right direction (the width direction of the white keys 10) of the bottom-section hinges 111. However, depending on a direction (angle) of key touching, the white keys 10 tend to rotate around an axis Ob in a longitudinal direction (a longitudinal direction of the white keys 10). Also, similarly, the white keys 10 connected to the middle-section hinges 121 and the black keys 20 connected to the upper-section hinges 131 also tend to rotate around the axis in the longitudinal direction depending on the direction of key touching. In the following description, this "rotation of the white keys 10 and the black keys 20 around an axis in the longitudinal direction" will be simply described as "rolling".

In this case, for example, in the case of a configuration in which a guide mechanism for guiding rocking (rotation) caused by key touching of the white keys 10 and the black keys 20 is provided, in addition to being able to guide rotation of the white keys 10 and the black keys 20 around the axis Oa using the guide mechanism, rolling (rotation around the axis Ob) can also be curbed. For example, the guide mechanism indicates a mechanism in which the white keys 10 and the black keys 20 are formed to have a box shape having an opening on a lower surface side and a guidepost (a member having a bushing) slidable in the opening portion on the lower surface side of the white keys 10 and the black keys 20 is provided in the chassis 30.

However, when such a guide mechanism is provided, rolling can be curbed, whereas the shapes of the white keys 10 and the black keys 20 become complicated and there is a need to provide a guidepost in the chassis 30, and thus product costs of the keyboard device 1 are high. Moreover, there is a need to apply a grease to sliding portions between the white keys 10 and the black keys 20 and the guidepost, and thus it takes time and effort for maintenance of the keyboard device 1.

In contrast, in the present embodiment, since such a guide mechanism is omitted, product costs of the keyboard device 1 can be curbed, and maintenance can be facilitated. On the other hand, although rolling is likely to occur because the guide mechanism is omitted, rigidities of the hinges against rolling is increased, and thus rolling is curbed. The rigidities of the hinges will be described with reference to FIG. 3.

Figure 3:
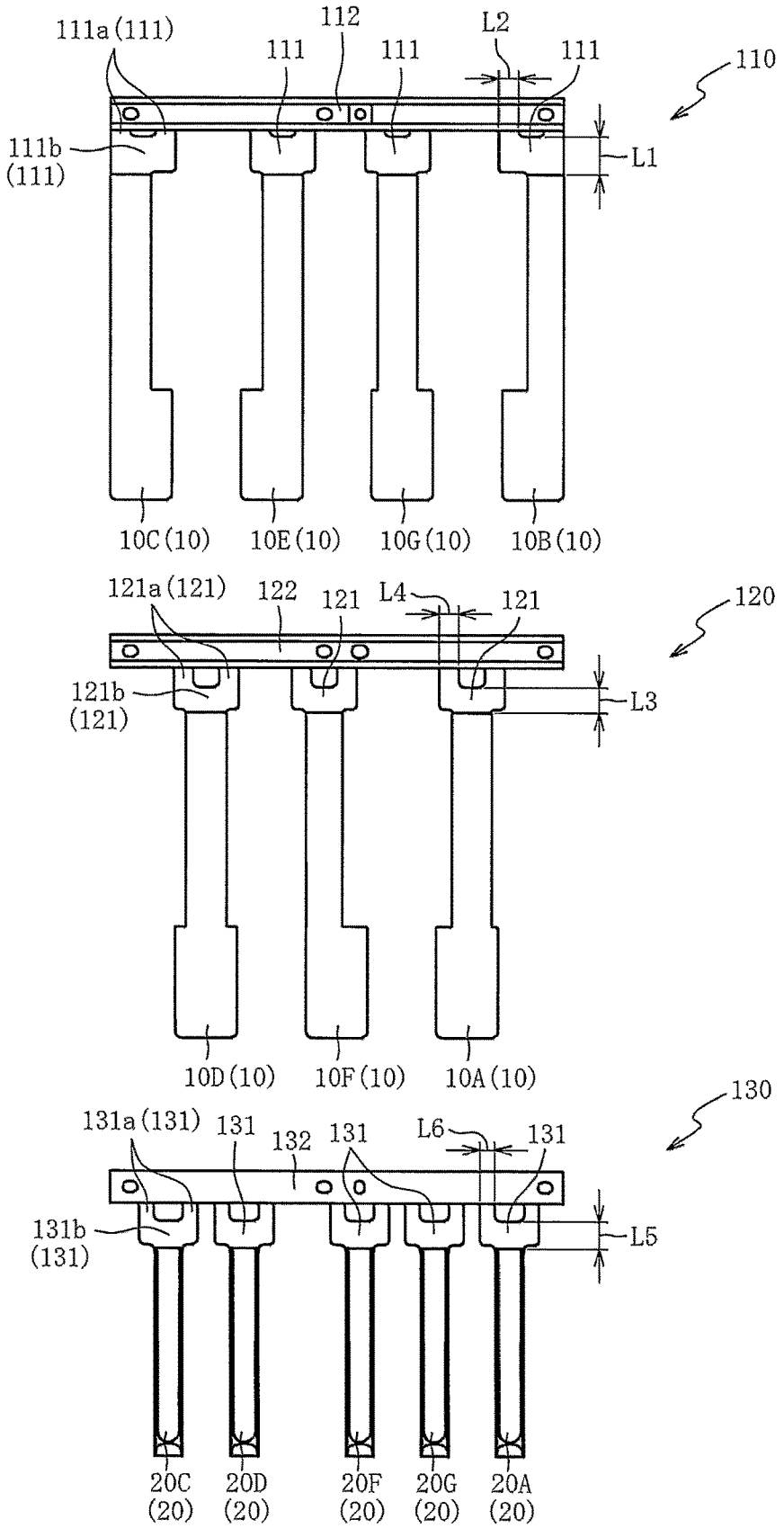
FIG. 3 is a top view of a bottom-section unit, a middle-section unit, and an upper-section unit.

FIG. 3 is a top view of the bottom-section unit 110, the middle-section unit 120, and the upper-section unit 130. In FIG. 3, in order to simplify the drawings, each of the units 110, 120, and 130 is schematically illustrated by omitting a portion of the configuration thereof.

As illustrated in FIG. 3, each of the bottom-section hinges 111 of the bottom-section unit 110 includes a pair of base parts 111*a* of which base ends are joined to the bottom-section support member 112 and which are provided such that they are separated from each other with a predetermined gap therebetween in the left-right direction, and a connection part 111*b* which connects the pair of base parts 111*a* to the white key 10. Each of the base parts 111*a* and the connection part 111*b* is formed to have substantially a rectangular shape in a top view, and the pair of base parts 111*a* are formed to have substantially the same shape in a top view.

Also, similarly, the middle-section hinges 121 and the upper-section hinges 131 of the middle-section unit 120 and the upper-section unit 130 include base parts 121*a* and 131*a* and connection parts 121*b* and 131*b* having configurations similar to the base parts 111*a* and the connection parts 111*b* of the bottom-section hinges 111 except that dimensions of the connection parts 121*b* and 131*b* in the longitudinal direction are different. Thus, a penetration hole having substantially a rectangular shape surrounded by each of the support members 112, 122, and 132, the base parts 111*a*, 121*a*, and 131*a*, and the connection parts 111*b*, 121*b*, and 131*b* in a top view is formed in each of the hinges 111, 121, and 131.

The dimension of each of the hinges 111, 121, and 131 in longitudinal direction or the left-right direction (dimensions of the hinges in their entireties) are set to be substantially the same dimensions as each other. The expression "substantially the same" means to allow unevenness in manufacturing steps, material, and measurement. Specifically, the expression "substantially the same" is defined as a range of ±10%, and the same applies in the following description.

In the bottom-section hinges 111, a longitudinal direction (a longitudinal direction of the white keys 10) dimension L1 of the connection part 111*b* is set to be larger than left-right direction (width direction of the white keys 10) dimensions L2 of the base parts 111*a*. In the middle-section hinges 121, a longitudinal-direction dimension L3 of the connection part 121*b* is set to be larger than left-right direction dimensions L4 of the base parts 121*a*. Also, in the upper-section hinges 131, a longitudinal-direction dimension L5 of the connection part 131*b* is set to be larger than left-right direction dimensions L6 of the base parts 131*a*.

Accordingly, the rigidities of the connection parts 111*b*, 121*b*, and 131*b*, namely, the rigidity of each of the hinges 111, 121, and 131 can be increased on a side near connection portions with respect to the white keys 10 and the black keys 20 (deformation due to rolling can be curbed). Thus, it is no longer necessary to separately provide a member for restricting rolling of the white keys 10 and the black keys 20, and therefore product costs of the keyboard device 1 can be reduced. Moreover, even when the guide mechanism described above is not provided, rolling can be curbed, and therefore product costs of the keyboard device 1 can be further reduced.

Each of the longitudinal-direction dimensions of the connection parts 111*b*, 121*b*, and 131*b* indicates a length of each of the hinges 111, 121, and 131 described above from a front end of the penetration hole to the base ends of the keys 2 (the white keys 10 and the black keys 20).

Figure 4A:
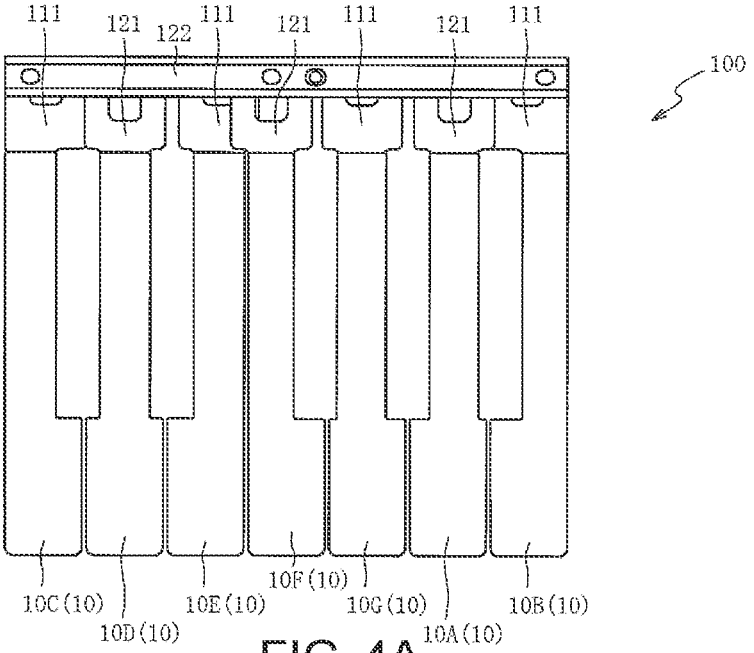
FIG. 4A is a top view of a key unit illustrating a state in which the middle-section unit overlaps the bottom-section unit.

Next, with reference to FIG. 4A and FIG. 4B, a case in which the bottom-section unit 110, the middle-section unit 120, and the upper-section unit 130 overlap each other will be described. FIG. 4A is a top view of the key unit 100 illustrating a state in which the middle-section unit 120 overlaps the bottom-section unit 110 (the upper-section unit 130 is detached), and FIG. 4B is a top view of the key unit 100 illustrating a state in which the bottom-section unit 110, the middle-section unit 120, and the upper-section unit 130 overlap each other.

As illustrated in FIG. 4A, when the middle-section support member 122 of the middle-section unit 120 overlaps the bottom-section support member 112 of the bottom-section unit 110 (refer to FIG. 3), the middle-section hinges 121 are disposed at positions overlapping portions of the bottom-section hinges 111 in a top view. More specifically, the middle-section hinge 121 to which the white key 10D is connected is disposed at a position overlapping the bottom-section hinge 111 to which the white key 10C is connected, the middle-section hinge 121 to which the white key 10F is connected is disposed at a position overlapping the bottom-section hinge 111 to which the white key 10E is connected, and the middle-section hinge 121 to which the white key 10A is connected is disposed at a position overlapping the bottom-section hinge 111 to which the white key 10B is connected.

Figure 4B:
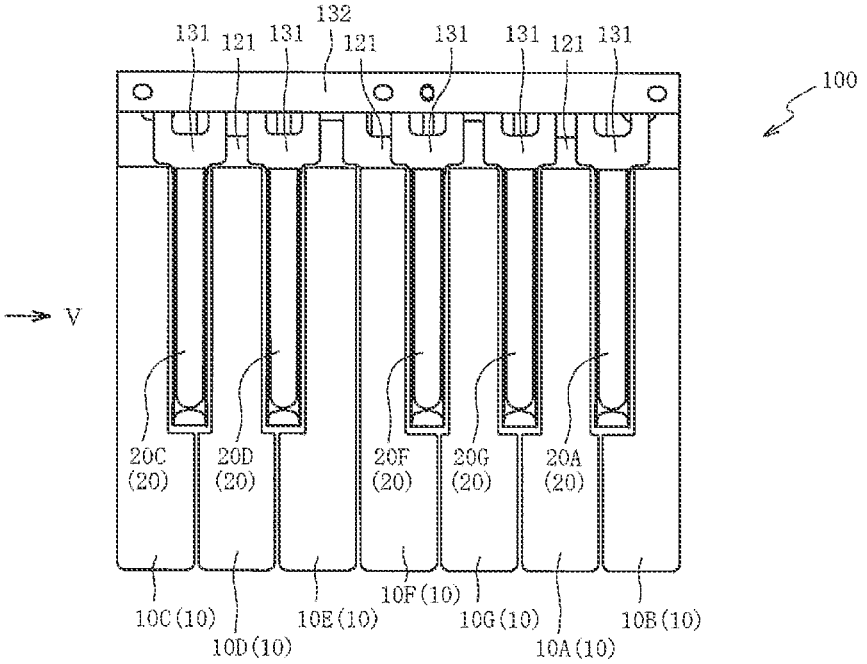
FIG. 4B is a top view of the key unit illustrating a state in which the bottom-section unit, the middle-section unit, and the upper-section unit overlap each other.

As illustrated in FIG. 4B, when the upper-section support member 132 of the upper-section unit 130 overlaps the middle-section support member 122 of the middle-section unit 120, the upper-section hinges 131 are disposed at positions overlapping the middle-section hinges 121 in a top view. More specifically, each of the upper-section hinges 131 to which the black keys 20C and 20D are connected is disposed at a position overlapping the middle-section hinge 121 to which the white key 10D is connected, the upper-section hinge 131 to which the black key 20F is connected is disposed at a position overlapping the middle-section hinge 121 to which the white key 10F is connected, and each of the upper-section hinges 131 to which the black keys 20G and 20A are connected is disposed at a position overlapping the middle-section hinge 121 to which the white key 10A is connected.

In this manner, since each of the hinges 111, 121, and 131 is disposed such that they overlap each other in a top view, the left-right direction dimension of each of the hinges 111, 121, and 131 can be made larger than the narrow width parts 11 of the white keys 10 and the black keys 20. Thus, the rigidity of each of the hinges 111, 121, and 131 against rolling can be increased, and therefore occurrence of rolling can be curbed.

Figure 5:
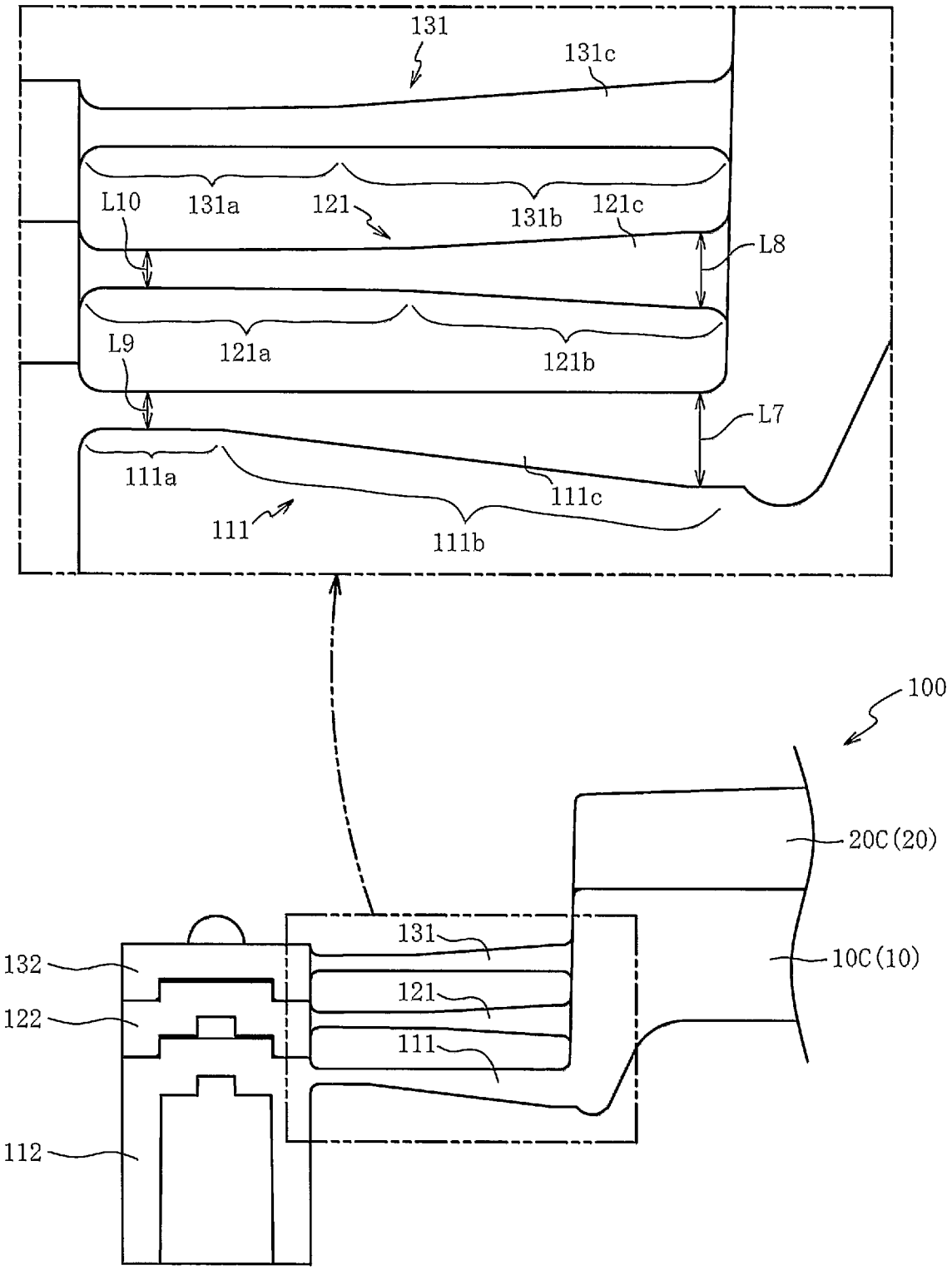
FIG. 5 is a partial enlarged side view of the key unit viewed in a direction of the arrow V in FIG. 4B.

On the other hand, since each of the hinges 111, 121, and 131 is disposed such that they overlap each other, each of the hinges 111, 121, and 131 has a different height (a joint height with respect to each of the support members 112, 122, and 132), and thus a difference is likely to occur in stress acting on each of the hinges 111, 121, and 131 due to rolling. This difference in stress will be described with reference to FIG. 5. FIG. 5 is a partial enlarged side view of the key unit 100 viewed in a direction of the arrow V in FIG. 4B.

As illustrated in FIG. 5, since each of the white keys 10 is disposed such that upper surfaces thereof become flush with each other, a distance from the upper surfaces of the white keys 10 to the bottom-section hinges 111 is longer than a distance from the upper surfaces of the white keys 10 to the middle-section hinges 121. Namely, a distance from rotary axes of the white keys 10 at the time of rolling is longer in the bottom-section hinges 111. Thus, stress (moment) acting due to rolling is larger in the bottom-section hinges 111 than in the middle-section hinges 121.

Therefore, even when the white keys 10 are touched with the same force, rolling is more likely to occur in the white keys 10 connected to the bottom-section hinges 111 than in the white keys 10 connected to the middle-section hinges 121. Therefore, a difference is likely to occur in feeling of touching the white keys 10 (key touching feeling).

In contrast, in the present embodiment, the rigidity against rolling is set to be higher in the bottom-section hinges 111 than in the middle-section hinges 121. More specifically, thickness dimensions L7 of the connection parts 111*b* of the bottom-section hinges 111 are set to be larger than thickness dimensions L8 of the connection parts 121*b* of the middle-section hinges 121, and therefore the rigidity against rolling can be further increased in the bottom-section hinges 111 than in the middle-section hinges 121.

Also, as illustrated in FIG. 3, the longitudinal-direction dimensions L1 of the connection parts 111*b* of the bottom-section hinges 111 are set to be larger than the longitudinal-direction dimensions L3 of the connection parts 121*b* of the middle-section hinges 121. Therefore, for this reason as well, the rigidity against rolling can be further increased in the bottom-section hinges 111 than in the middle-section hinges 121.

In this manner, by increasing the rigidities of the bottom-section hinges 111 in which stress due to rolling is more likely to occur than in the middle-section hinges 121, occurrence of a difference in likelihood of occurrence of rolling between the white keys 10 connected to the bottom-section hinges 111 and the white keys 10 connected to the middle-section hinges 121 can be curbed. Thus, a feeling of touching each of the white keys 10 can be made uniform.

Also, a thickness dimension of the bottom-section support member 112 is set to be larger than a thickness dimension of the middle-section support member 122, and the bottom-section hinges 111 are connected to an upper end portion of a front surface (a surface on the right side in FIG. 5) of the bottom-section support member 112. Accordingly, the distances between the bottom-section hinges 111 and the upper surfaces of the white keys 10 can be shortened, and therefore stress acting on the bottom-section hinges 111 at the time of rolling can be reduced. Accordingly, when the white keys 10 tend to roll, deformation of the bottom-section hinges 111 can be curbed, and therefore rolling can be curbed.

Here, for example, if the purpose is simply to increase the rigidities of the bottom-section hinges 111 against rolling, it is possible to employ a configuration in which the thickness dimensions of the base parts 111*a* of the bottom-section hinges 111 are similarly set to be larger than the thickness dimensions of the base parts 121*a* of the middle-section hinges 121 (namely, the thickness dimensions of the bottom-section hinges 111 in their entireties are set to be larger than those of the middle-section hinges 121).

However, in such a configuration, a difference is likely to occur in likelihood of rotation of the white keys 10 in the key touching direction (rotation around the axis Oa) (refer to FIG. 2). Thus, a difference is likely to occur in feeling of touching between the white keys 10 connected to the bottom-section hinges 111 and the white keys 10 connected to the middle-section hinges 121.

In contrast, in the present embodiment, a thick part 111*c* is formed in each of the connection parts 111*b* of the bottom-section hinges 111, and the thickness dimension L7 of the thick part 111*c* is set to be larger than thickness dimensions L9 of the base parts 111*a*. Also, a thick part 121*c* is formed in each of the connection parts 121*b* of the middle-section hinges 121, and the thickness dimension L8 of the thick part 121*c* is set to be larger than thickness dimensions L10 of the base parts 121*a*. Also, the thickness dimensions L9 of the base parts 111*a* of the bottom-section hinges 111 are set to be substantially the same as the thickness dimensions L10 of the base parts 121*a* of the middle-section hinges 121.

Accordingly, the rigidity of each of the hinges 111 and 121 against rolling is secured by the thick parts 111*c* and 121*c* which are relatively thick, whereas deformation of each of the hinges 111 and 121 due to rocking of the white keys 10 in the key touching direction mainly occurs in the base parts 111*a* and 121*a* which are relatively thin. Thus, by setting the thickness dimensions L9 and L10 of the base parts 111*a* and 121*a* to be substantially the same as each other in the bottom-section hinges 111 and the middle-section hinges 121, a feeling of touching can be made uniform in the white keys 10 connected to the bottom-section hinges 111 and the white keys 10 connected to the middle-section hinges 121.

Also, similarly in the upper-section hinges 131, a thick part 131*c* having a larger thickness dimension than the base parts 131*a* is formed in the connection part 131*b*. In this manner, by setting the thickness dimensions of the connection parts 111*b*, 121*b*, and 131*b* of the hinges 111, 121, and 131 to be larger than those of the base parts 111*a*, 121*a*, and 131*a*, the rigidity of each of the hinges 111, 121, and 131 can be increased on a side near the connection portions with respect to the white keys 10 and the black keys 20, and therefore occurrence of rolling can be curbed.

In this case, if the purpose is simply to increase the rigidities of the connection parts 111*b*, 121*b*, and 131*b*, for example, it is possible to employ a configuration in which the thick part 111*c* protrudes on the upper surface side of the connection part 111*b* or both upper and lower surface sides. However, as described above, in a top view, the middle-section hinges 121 are disposed at positions overlapping portions of the bottom-section hinges 111 (refer to FIG. 4A and FIG. 4B), and the upper-section hinges 131 are disposed at positions overlapping the middle-section hinges 121.

Thus, for example, in the case of a configuration in which the thick part 111*c* protrudes on the upper surface side of the connection part 111*b* of the bottom-section hinge 111, when the middle-section hinge 121 is deformed to the bottom-section hinge 111 side (downward) due to key touching, there is concern that the middle-section hinge 121 may interfere with the thick part 111*c* of the bottom-section hinge 111. In order to curb the interference, if gaps between the bottom-section hinges 111 and the middle-section hinges 121 vertically opposite to each other are widened (joint positions of the bottom-section hinges 111 with respect to the bottom-section support member 112 is lowered), the distances from the rotary axes of the white keys 10 to the bottom-section hinges 111 at the time of rolling are lengthened, and thus rolling is likely to occur.

In contrast, in the present embodiment, the thick parts 111*c* of the bottom-section hinges 111 are formed to project downward from the connection parts 111*b*, the thick parts 121*c* of the middle-section hinges 121 are formed to project upward and downward from the connection parts 121*b*, and the thick parts 131*c* of the upper-section hinges 131 are formed to project upward from the connection parts 131*b*.

Namely, in the bottom-section hinges 111, the thick parts 111*c* are eccentric downward from centers of the base parts

111*a* in the vertical direction. In the middle-section hinges, the thick parts 121*c* are positioned substantially at the same height as centers of the base parts 121*a* in the vertical direction. Also, in the upper-section hinges 131, the thick parts 131*c* are eccentric upward from centers of the base parts 131*a* in the vertical direction.

Accordingly, when the white keys 10 and the black keys 20 are touched, interference of the thick parts 111*c*, 121*c*, and 131*c* with each of the hinges 111, 121, and 131 can be curbed. Thus, gaps between the hinges 111, 121, and 131 vertically opposite to each other can be narrowed as much as possible, and therefore the joint positions of the bottom-section hinges 111 with respect to the bottom-section support member 112 and the joint positions of the middle-section hinges 121 with respect to the middle-section support member 122 can be raised. Thus, the distances from the rotary axes of the white keys 10 to the bottom-section hinges 111 and the middle-section hinges 121 at the time of rolling can be shortened, and therefore rolling of the white keys 10 can be curbed.

Also, the thick parts 111*c*, 121*c*, and 131*c* are formed to have tapered shapes in which the thickness dimensions gradually increase from the side of each of the support members 112, 122, and 132 to the side of the keys 2 (the white keys 10 and the black keys 20). Accordingly, the rigidity of each of the hinges 111, 121, and 131 can be gradually increased from a part on the side of each of the support members 112, 122, and 132 (the base end side) where stress due to rolling is less likely to occur to a part on the side of the keys 2 (the distal end side) where stress is more likely to occur. Thus, the thickness dimensions of the thick parts 111*c*, 121*c*, and 131*c* can be reduced as much as possible, and rolling can be curbed.

Also, since the thick parts 111*c*, 121*c*, and 131*c* are formed to have tapered shapes, a resin can flow smoothly at the time of integrated molding of each of the units 110, 120, and 130 with a mold using a resin material. Moreover, concentration of stress in portions of the thick parts 111*c*, 121*c*, and 131*c* at the time of rolling can be curbed, and therefore durability of each of the hinges 111, 121, and 131 can be improved.

Next, with reference to FIG. 6A and FIG. 6B, a second embodiment will be described. In the first embodiment, a case in which the longitudinal-direction dimension of the connection part 111*b* is substantially the same in each of the bottom-section hinges 111 of the bottom-section unit 110 and the longitudinal-direction dimension of the connection part 121*b* is substantially the same in each of the middle-section hinges 121 of the middle-section unit 120 has been described. In contrast, in the second embodiment, a case in which the longitudinal-direction dimension of the connection part 111*b* varies in a portion of each of the bottom-section hinges 111 and the longitudinal-direction dimension of the connection part 121*b* varies in each of the middle-section hinges 121 will be described.

The bottom-section hinges 111 and the middle-section hinges 121 of the second embodiment has the same configuration as the bottom-section hinges 111 and the middle-section hinges 121 of the first embodiment except that the longitudinal-direction dimensions of the connection parts 111*b* and 121*b* are different. Therefore, description will be given by applying the same reference signs as those of the first embodiment. FIG. 6A is a top view of a bottom-section unit 210 according to the second embodiment, and FIG. 6B is a top view of a middle-section unit 220.

Figure 6A:
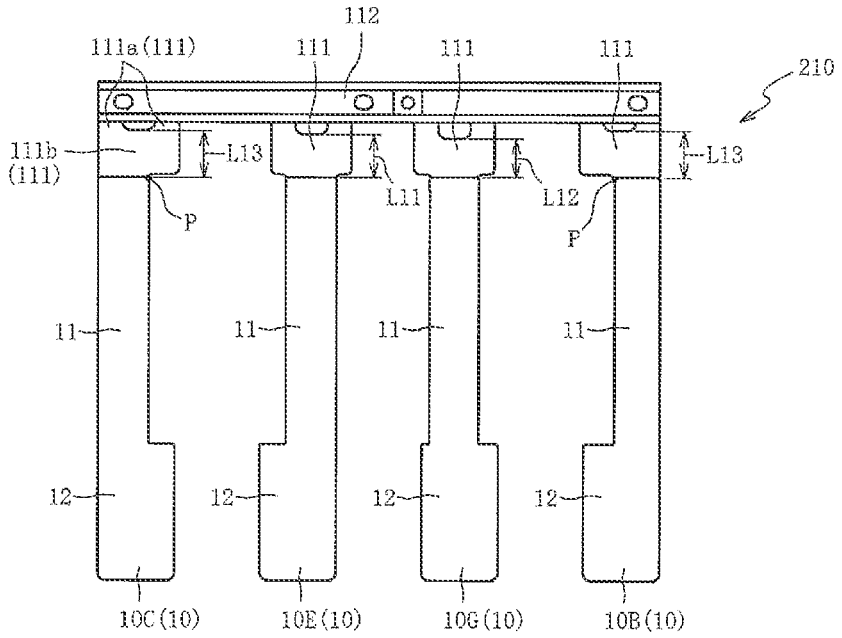
FIG. 6A is a top view of a bottom-section unit according to a second embodiment.

As illustrated in FIG. 6A, in the white keys 10C and 10B of the bottom-section unit 210, the narrow width parts 11 are connected to parts at positions eccentric from the centers of the connection parts 111*b* of the bottom-section hinges 111 in the left-right direction. Thus, if rolling occurs in the white keys 10C and 10B, stress is likely to occur in connection portions P with respect to end parts of the narrow width parts 11 in the left-right direction. As the connection portions P become closer to the centers of the connection parts 111*b* of the bottom-section hinges 111 in the left-right direction, the bottom-section hinges 111 are more likely to deform.

Namely, the bottom-section hinges 111 to which the white keys 10C and 10B (second white keys) are connected are more likely to deform due to rolling than those for the white keys 10E and 10G (first white keys) in which the narrow width parts 11 are connected to the centers of the connection parts 111*b* in the left-right direction. Thus, even when key touching is performed with the same force, rolling is more likely to occur in the white keys 10C and 10B than in the white keys 10E and 10G.

In contrast, in the present embodiment, longitudinal-direction dimensions L13 of the connection parts 111*b* of the bottom-section hinges 111 to which the white keys 10C and 10B (second white keys) are connected are set to be larger than longitudinal-direction dimensions L11 and L12 of the connection parts 111*b* of the bottom-section hinges 111 to which the white keys 10E and 10G (first white keys) are connected. Thus, the rigidity against rolling can be increased in the bottom-section hinges 111 to which the white keys 10C and 10B where rolling is more likely to occur are connected, and therefore a feeling of touching the white keys 10C, 10E, 10G, and 10B can be made uniform.

On the other hand, although each of the white keys 10E and 10G is connected to the center of the connection part 111*b* in the left-right direction, compared to the wide width part 12 of the white keys 10G (third white key), the wide width part 12 of the white key 10E (fourth white key) is connected to a position eccentric from the center of the narrow width part 11 in the left-right direction. Thus, when the wide width parts 12 are touched, in the white key 10E having a large eccentricity amount of the wide width part 12 with respect to the narrow width part 11, a part at a position away from the rotary axis of the white key 10 (narrow width part 11) at the time of rolling is more likely to be touched.

Therefore, significant stress is more likely to occur at the time of rolling in the bottom-section hinge 111 to which the white key 10E is connected than in the bottom-section hinge 111 to which the white key 10G is connected. Namely, even when key touching is performed with the same force, rolling is more likely to occur in the white key 10E than in the white key 10G.

In contrast, in the present embodiment, the longitudinal-direction dimension L11 of the connection part 111*b* of the bottom-section hinge 111 to which the white key 10E (fourth white key) is connected is set to be larger than the longitudinal-direction dimension L12 of the connection part 111*b* of the bottom-section hinge 111 to which the white key 10G (third white key) is connected. Thus, in the bottom-section hinge 111 to which the white key 10E where rolling is more likely to occur is connected, the rigidity against rolling can be increased, and therefore a feeling of touching the white keys 10C, 10E, 10G, and 10B can be made more uniform.

Figure 6B:
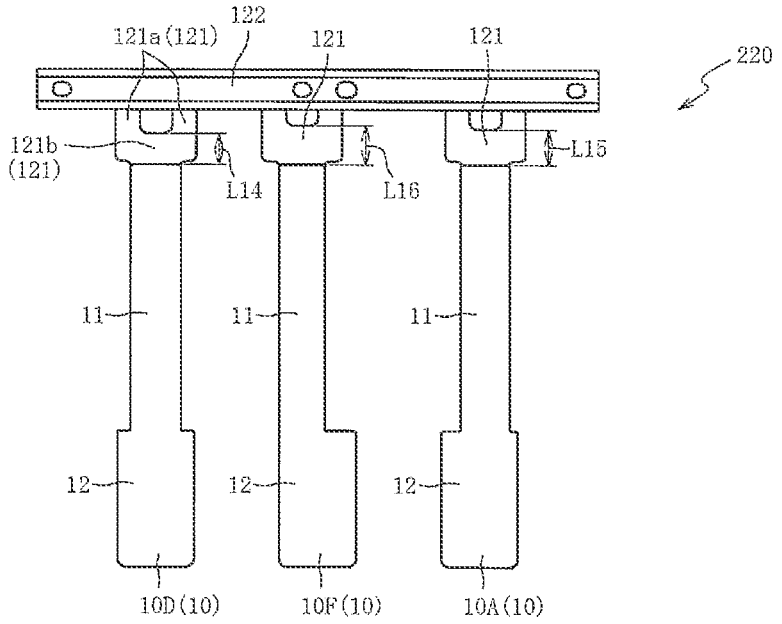
FIG. 6B is a top view of a middle-section unit.

As illustrated in FIG. 6B, although the white keys 10D, 10F, and 10A of the middle-section unit 220 are respectively connected to the centers of the connection parts 121*b* of the middle-section hinges 121 in the left-right direction, the eccentricity amount of the wide width part 12 with respect to the narrow width part 11 is larger in the white key 10A (fourth white key) than in the white key 10D (third white key) and is larger in the white key 10F (fourth white key) than in the white key 10A (third white key).

In contrast, in the present embodiment, a longitudinal-direction dimension L15 of the connection part 121*b* to which the white key 10A (fourth white key) is connected is set to be larger than a longitudinal-direction dimension L14 of the connection part 121*b* to which the white key 10D (third white key) is connected. Also, a longitudinal-direction dimension L16 of the connection part 121*b* to which the white key 10F (fourth white key) is connected is set to be larger than a longitudinal-direction dimension L15 of the connection part 121*b* to which the white key 10A (third white key) is connected.

Accordingly, the rigidity against rolling can be further increased in the middle-section hinges 121 to which the white keys 10 where rolling is more likely to occur are connected, and therefore a feeling of touching of the white keys 10D, 10F, and 10A can be made uniform.

Also, the narrow width parts 11 of the white keys 10F and 10G are respectively connected to the centers of the connection parts 111*b* and 121*b* in the left-right direction, but the eccentricity amount of the wide width part 12 with respect to the narrow width part 11 is larger in the white key 10F than in the white key 10G. Namely, a part at a position away from the rotary axis of the narrow width part 11 at the time of rolling is more likely to be touched in the white key 10F than in the white key 10G.

On the other hand, as described in the first embodiment, stress occurring at the time of rolling is more likely to increase in the middle-section hinge 121 to which the white key 10F is connected than in the bottom-section hinge 111 to which the white key 10G is connected (because the distances from the upper surfaces of the white keys 10F and 10G to the bottom-section hinges 111 are longer). Thus, in the present embodiment, the longitudinal-direction dimensions L12 and L16 of the connection parts 111*b* and 121*b* are set to be substantially the same dimensions as each other in the bottom-section hinge 111 to which the white key 10G is connected and the middle-section hinge 121 to which the white key 10F is connected. Accordingly, a feeling of touching the white keys 10 connected to the respective hinges 111 and 121 can be made uniform.

Also, in each of the hinges 111 and 121, the longitudinal-direction dimensions of the connection parts 111*b* and 121*b* are set to be larger than the left-right direction dimensions of the base parts 111*a* and 121*a*. Accordingly, similar to the first embodiment, the rigidity of each of the hinges 111 and 121 can be increased on a side near the connection portions with respect to the white keys 10 (deformation due to rolling can be curbed). Thus, it is no longer necessary to separately provide a member for restricting rolling of the white keys 10, and therefore product costs of the keyboard device can be reduced.

Hereinabove, description has been given on the basis of the foregoing embodiments. The present invention is not limited to the foregoing embodiments in any way, and it can be easily inferred that various improvements and modifications can be made within a range not departing from the gist of the present invention. For example, in each of the foregoing embodiments, as another embodiment, some or all of the configurations in one embodiment may be combined or replaced with some or all of the configurations in the other embodiment.

In each of the foregoing embodiments, a case in which the keyboard device 1 is constituted as an electric piano has been described, but the embodiments are not necessarily limited thereto. For example, the technical ideas of the foregoing embodiments can also be applied to other electronic musical instruments (for example, an electronic organ and an accordion) and small-sized electronic musical instruments in which the left-right direction dimensions of the keys are further reduced than those of standard keyboard instruments. Standard keyboard instruments indicate standard keyboard instruments stipulated in JIS S8507 (1992 edition).

In each of the foregoing embodiments, a case in which a guide mechanism for guiding rocking of the white keys 10 and the black keys 20 is omitted has been described, but the embodiments are not necessarily limited thereto and a configuration in which a guide mechanism is provided may be adopted. For example, a guide mechanism is a mechanism in which the white keys 10 and the black keys 20 are formed to have a box shape having an opening on a lower surface side and a guidepost (a member having a bushing) slidable in the opening portion on the lower surface side of the white keys 10 and the black keys 20 is provided in the chassis 30.

In each of the foregoing embodiments, a case in which the white keys 10 and the black keys 20, each of the hinges 111, 121, and 131, and each of the support members 112, 122, and 132 are integrally formed using a resin material has been described, but the embodiments are not necessarily limited thereto. For example, white keys, black keys, hinges, and support members may be formed as separate bodies using materials different from each other (for example, wood, metal, resin, and the like), and these may be joined to each other using a suitable joining means (for example, an adhesive or a screw).

In each of the foregoing embodiments, a case in which the left-right direction dimension of each of the hinges 111, 121, and 131 is set to be larger than those of the white keys 10 (narrow width parts 11) and the black keys 20 has been described, but the embodiments are not necessarily limited thereto. For example, the left-right direction dimensions of the white keys 10 (narrow width parts 11) and the black keys 20 may be set to be substantially the same as the left-right direction dimension of each of the hinges 111, 121, and 131.

In each of the foregoing embodiments, a case in which the joint height with respect to each of the support members 112, 122, and 132 varies in each of the hinges 111, 121, and 131 has been described, but the embodiments are not necessarily limited thereto. For example, a configuration in which the white keys 10 and the black keys 20 are supported by a plurality of hinges having the same joint height with respect to the support member (arranged in a row in the left-right direction) may be adopted.

In each of the foregoing embodiments, a case in which the white keys 10C, 10E, 10G, and 10B are supported by the bottom-section support member 112 for every other pitch name and the white keys 10D, 10F, and 10A are supported by the middle-section support member 122 for every other pitch name has been described, but the embodiments are not necessarily limited thereto. A combination of the white keys 10 supported by the bottom-section support member 112 and the middle-section support member 122 can be suitably set, and a configuration in which they are supported for every other pitch name may not be adopted.

In each of the foregoing embodiments, a case in which the base parts 111*a*, 121*a*, and 131*a* of the respective hinges 111, 121, and 131 are formed to have substantially a rectangular shape in a top view, namely, a case in which the left-right direction dimensions of the base parts 111*a*, 121*a*, and 131*a* are uniform from the base end side to the distal end side has been described, but the embodiments are not necessarily limited thereto.

For example, a configuration in which the left-right direction dimension of the base part is gradually reduced or increased from the base end side to the distal end side may be adopted. Namely, a configuration in which the left-right direction dimension of the base part varies in a region of a portion from the base end side to the distal end side may be adopted. In this case, it is preferable that the longitudinal-direction dimensions of the connection parts 111*b*, 121*b*, and 131*b* be set to be larger than the smallest value of the left-right direction dimension of the base part, and it is more preferable that the longitudinal-direction dimensions of the connection parts 111*b*, 121*b*, and 131*b* be set to be larger than the largest value of the left-right direction dimension of the base part.

In the case of a configuration in which the longitudinal-direction dimensions of the connection parts 111*b*, 121*b*, and 131*b* are set to be larger than at least the smallest value of the left-right direction dimension of the base part, the rigidity of each of the hinges 111, 121, and 131 against rolling can be increased. Also, in the case of a configuration in which the longitudinal-direction dimensions of the connection parts 111*b*, 121*b*, and 131*b* are set to be larger than the largest value of the left-right direction dimension of the base part, the rigidity of each of the hinges 111, 121, and 131 against rolling can be further increased (※ At the time of the conference over the phone, I have been instructed that it is preferable to have a dimension of the connection part larger than at least the smallest dimension of the base part. By way of caution, I have described that it is preferable to have a dimension of the connection part larger than the largest dimension of the base part).

In each of the foregoing embodiments, a case in which the pair of base parts 111*a*, 121*a*, and 131*a* are formed to have substantially the same shape as each other in a top view, namely, a case in which the left-right direction dimension is the same in each of the pair of base parts 111*a*, 121*a*, and 131*a* has been described, but the embodiments are not necessarily limited thereto. For example, a configuration in which the left-right direction dimension of one base part of the pair of base parts is set to be smaller than the left-right direction dimension of the other base part may be adopted.

In this case, it is preferable that the longitudinal-direction dimensions of the connection parts 111*b*, 121*b*, and 131*b* be set to be larger than the left-right direction dimension of one base part (a base part having a small left-right direction dimension), and it is more preferable that the longitudinal-direction dimensions of the connection parts 111*b*, 121*b*, and 131*b* be set to be larger than the left-right direction dimension of the other base part (a base part having a large left-right direction dimension).

In the case of a configuration in which the longitudinal-direction dimensions of the connection parts 111*b*, 121*b*, and 131*b* are set to be larger than at least the left-right direction dimension of one base part, the rigidity of each of the hinges 111, 121, and 131 against rolling can be increased. Also, in the case of a configuration in which the longitudinal-direction dimensions of the connection parts 111*b*, 121*b*, and 131*b* are set to be larger than the left-right direction dimension of the other base part, the rigidity of each of the hinges 111, 121, and 131 against rolling can be further increased.

In each of the foregoing embodiments, a case in which the thickness dimensions of the base parts 111*a*, 121*a*, and 131*a* are substantially the same as each other in each of the hinges 111, 121, and 131 has been described, but the embodiments are not necessarily limited thereto. For example, a configuration in which the thickness dimensions of the base parts 111*a* of the bottom-section hinges 111 are set to be larger than the thickness dimensions of the base parts 121*a* of the middle-section hinges 121 may be adopted.

In each of the foregoing embodiments, a case in which the connection parts 111*b*, 121*b*, and 131*b* of the respective hinges 111, 121, and 131 are formed to have substantially a rectangular shape in a top view, namely, a case in which the left-right direction dimensions of the connection parts 111*b*, 121*b*, and 131*b* are uniform from the base end side to the distal end side has been described, but the embodiments are not necessarily limited thereto.

For example, a configuration in which the left-right direction dimension of the connection part is gradually reduced or increased from the base end side to the distal end side may be adopted. Namely, a configuration in which the left-right direction dimension of the connection part varies in a region of a portion from the base end side to the distal end side may be adopted. In the case of a configuration in which at least the longitudinal-direction dimension of the connection part (the dimension from the front end of the penetration hole of each of the hinges 111, 121, and 131 to the base ends of the keys 2) is set to be larger than the left-right direction dimensions of the base parts 111*a*, 121*a*, and 131*a*, the rigidity of each of the hinges 111, 121, and 131 against rolling can be increased.

In each of the foregoing embodiments, a case in which the thickness dimensions of the connection parts 111*b*, 121*b*, and 131*b* of each of the hinges 111, 121, and 131 are set to be larger than the thickness dimensions of the base parts 111*a*, 121*a*, and 131*a* has been described, but the embodiments are not necessarily limited thereto. For example, the thickness dimensions of the connection parts 111*b*, 121*b*, and 131*b* and the thickness dimensions of the base parts 111*a*, 121*a*, and 131*a* may be set to be substantially the same.

In each of the foregoing embodiments, a case in which the thick parts 111*c*, 121*c*, and 131*c* are formed to have tapered shapes has been described, but the embodiments are not necessarily limited thereto. As long as the rigidities of the connection parts 111*b*, 121*b*, and 131*b* can be increased, the shapes thereof are not limited. Thus, for example, a thick part projecting upward or downward (or in both directions) from the connection parts 111*b*, 121*b*, and 131*b* in a rib shape may be formed.

In each of the foregoing embodiments, a case in which the longitudinal-direction dimensions of the connection parts 111*b*, 121*b*, and 131*b* are varied in each of the hinges 111, 121, and 131 has been described, but the embodiments are not necessarily limited thereto. For example, the longitudinal-direction dimensions of the connection parts 111*b*, 121*b*, and 131*b* may be set to be substantially the same as each other in each of the hinges 111, 121, and 131.

In the case of a configuration in which at least the longitudinal-direction dimensions of the connection parts 111*b*, 121*b*, and 131*b* are larger than the left-right direction dimensions of the base parts 111*a*, 121*a*, and 131*a*, it is possible to curb rolling of the white keys 10 and the black keys 20. Also, a configuration in which the longitudinal-direction dimension of the connection part is set to be larger than the left-right direction dimension of the base part in only the hinges to which the white keys 10 are connected (or the hinges to which the black keys 20 are connected) may be adopted.

Also, the longitudinal-direction dimensions of the connection parts 111*b* of the bottom-section hinges 111 and the connection parts 121*b* of the middle-section hinges 121 may be set to be substantially the same as each other, and the difference between the rigidities against rolling may be adjusted based on only the difference between the thickness dimensions of the thick parts 111*c* and 121*c*.

In each of the foregoing embodiments, a case in which the thickness dimensions of the thick parts 111*c* of the bottom-section hinges 111 are set to be larger than the thickness dimensions of the thick parts 121*c* of the middle-section hinges 121 has been described, but the embodiments are not necessarily limited thereto. For example, the thickness dimensions of the thick parts 111*c* of the bottom-section hinges 111 and the thickness dimensions of the thick parts 121*c* of the middle-section hinges 121 may be set to be substantially the same as each other, and the difference between the rigidities against rolling may be adjusted based on only the difference between the longitudinal-direction dimensions of the connection parts 111*b* of the bottom-section hinges 111 and the connection parts 121*b* of the middle-section hinges 121. Also, a configuration in which the thick parts 111*c*, 121*c*, and 131*c* of the respective hinges 111, 121, and 131 are omitted may be adopted.

REFERENCE SIGNS LIST

1 Keyboard device
2 Key
10 White key (key)
10E, 10G White key (first white key)
10C, 10B White key (second white key)
10D, 10G White key (third white key)
10A White key (third white key or fourth white key)
10E, 10F White key (fourth white key)
11 Narrow width part
12 Wide width part
20 Black key (key)
111 Bottom-section hinge (hinge, first hinge)
111*a* Base part
111*b* Connection part
111*c* Thick part
112 Bottom-section support member (support member)
121 Middle-section hinge (hinge, second hinge)
121*a* Base part
121*b* Connection part
121*c* Thick part
122 Middle-section support member (support member)
131 Upper-section hinge (hinge, third hinge)
131*a* Base part
131*b* Connection part
131*c* Thick part
132 Upper-section support member (support member)

What is claimed is:

1. A keyboard device comprising:

a plurality of white keys, each of which is supported by a support member; and a plurality of hinges, each of which has:

a pair of base parts, joined to the support member and separated from each other with a predetermined gap therebetween in a width direction of the white keys, and a connection part, connecting the pair of base parts and each of the white keys to each other in a longitudinal direction of the white keys, wherein the hinges at least includes: first hinges, and second hinges which are joined to the support member on a side above the first hinges, and wherein a thickness of the connection part is set to be larger in the first hinges than in the second hinges.

2. The keyboard device according to claim 1, wherein the plurality of white keys at least includes: first white keys, and second white keys which are connected to positions more eccentric from centers of the hinges in the width direction of the keys than the first white keys, and wherein rigidities of the hinges with respect to rolling of the white keys are set to be higher in the hinges to which the second white keys are connected than in the hinges to which the first white keys are connected.

3. The keyboard device according to claim 1, wherein each of the plurality of white keys has a narrow width part having a base end connected to each of the hinges and extending in the longitudinal direction of the keys, and a wide width part connected to a distal end of the narrow width part and having a dimension in the width direction of the keys set to be larger than a dimension of the narrow width part, wherein the plurality of white keys at least includes: third white keys, and fourth white keys each of which has the wide width part connected to a position more eccentric from a center of the narrow width part in the width direction of the keys than the third white keys, and wherein rigidities of the hinges with respect to rolling of the white keys are set to be higher in the hinges to which the fourth white keys are connected than in the hinges to which the third white keys are connected.

4. A keyboard device comprising:

a plurality of keys, each of which is supported by a support member; and a plurality of hinges, each of which has:

a pair of base parts, joined to the support member and separated from each other with a predetermined gap therebetween in a width direction of the keys, and a connection part, connecting the pair of base parts and each of the keys to each other in a longitudinal direction of the keys, wherein a dimension of the connection part in the longitudinal direction of the keys is set to be larger than dimensions of the base parts in the width direction of the keys, wherein the plurality of keys includes a plurality of white keys, wherein the plurality of hinges at least includes: first hinges, and second hinges which are joined to the support member on a side above the first hinges, and wherein rigidities of the first hinges with respect to rolling of the white keys are set to be higher than rigidities of the second hinges;

wherein a thick part having a larger thickness dimension than the base parts is formed in the connection part, and wherein thickness dimensions of the base parts are set to be the same in the first hinges and the second hinges;

wherein the second hinges are disposed at positions overlapping the first hinges in a top view, and wherein in the first hinges, the thick part is eccentric downward from centers of the base parts in a vertical direction.

5. The keyboard device according to claim 4, wherein the plurality of keys includes a plurality of black keys, wherein the plurality of hinges at least includes: the first hinges, the second hinges, and third hinges which are joined to the support member on a side above the second hinges and to which the black keys are connected, wherein the third hinges are disposed at positions overlapping the second hinges in a top view, and wherein in the third hinges, the thick part is eccentric upward from the centers of the base parts in the vertical direction.

6. The keyboard device according to claim 5, wherein in the second hinges, the thick part is positioned at the centers of the base parts in the vertical direction.

7. The keyboard device according to claim 4, wherein the thick part is set to have a thickness dimension gradually increasing from a side of the support member to a side of the keys.

8. A keyboard device comprising:

a plurality of keys, each of which is supported by a support member; and a plurality of hinges, each of which has:

a pair of base parts, joined to the support member and separated from each other with a predetermined gap therebetween in a width direction of the keys, and a connection part, connecting the pair of base parts and each of the keys to each other in a longitudinal direction of the keys, wherein a dimension of the connection part in the longitudinal direction of the keys is set to be larger than dimensions of the base parts in the width direction of the keys, wherein the plurality of keys includes a plurality of white keys, wherein the plurality of hinges at least includes: first hinges, and second hinges which are joined to the support member on a side above the first hinges, and wherein rigidities of the first hinges with respect to rolling of the white keys are set to be higher than rigidities of the second hinges;

wherein dimensions of the hinges in the longitudinal direction of the keys are set to be the same as each other in the plurality of hinges, and wherein the dimension of the connection part in the longitudinal direction of the keys is set to be larger in the first hinges than in the second hinges;

wherein a thick part having a larger thickness dimension than the base parts is formed in the connection part, and wherein thickness dimensions of the base parts are set to be the same in the first hinges and the second hinges;

wherein the second hinges are disposed at positions overlapping the first hinges in a top view, and wherein in the first hinges, the thick part is eccentric downward from centers of the base parts in a vertical direction.

9. The keyboard device according to claim 8, wherein the plurality of keys includes a plurality of black keys, wherein the plurality of hinges at least includes: the first hinges, the second hinges, and third hinges which are joined to the support member on a side above the second hinges and to which the black keys are connected, wherein the third hinges are disposed at positions overlapping the second hinges in a top view, and wherein in the third hinges, the thick part is eccentric upward from the centers of the base parts in the vertical direction.

10. The keyboard device according to claim 9, wherein in the second hinges, the thick part is positioned at the centers of the base parts in the vertical direction.

11. The keyboard device according to claim 10, wherein the thick part is set to have a thickness dimension gradually increasing from a side of the support member to a side of the keys.

12. The keyboard device according to claim 9, wherein the thick part is set to have a thickness dimension gradually increasing from a side of the support member to a side of the keys.

* * * * *